United States Patent [19]

Lesgourgues

[11] 4,272,290

[45] Jun. 9, 1981

[54] NOVEL POROUS BODY AND PROCESS FOR ITS PREPARATION

[75] Inventor: Jacques Lesgourgues, Corbeil, France

[73] Assignee: Societe Nationale d'Etude et de Construction de Moteurs d'Aviation, Paris, France

[21] Appl. No.: 58,487

[22] Filed: Jul. 18, 1979

[30] Foreign Application Priority Data

Jul. 25, 1978 [FR] France ..... 78 21894

[51] Int. Cl.[3] ..... B22F 1/00; B22F 3/00

[52] U.S. Cl. ..... 75/212; 75/222; 415/174

[58] Field of Search ..... 75/212, 222; 415/174

[56] References Cited

U.S. PATENT DOCUMENTS

| | | | |
|---|---|---|---|
| 3,383,207 | 5/1968 | Butts | 75/222 |
| 4,011,077 | 3/1977 | Kaufman | 75/212 |
| 4,013,461 | 3/1977 | Elbert | 75/212 |

*Primary Examiner*—Brooks H. Hunt

[57] ABSTRACT

The invention concerns the manufacture of a porous product based on nickel, chromium, tungsten, molybdenum, iron, cobalt or an alloy of these metals. The porous product is characterized on one hand by the fact that it comprises 85 to 99.5% by weight of the base material and 15 to 0.5% of a fusible auxiliary metal chosen from among tin, indium, gallium, germanium and mixtures and alloys of these metals and, on the other hand, by the fact that the base material is in the form of elementary particles such as powders, fibers or chips, bonded to each other by means of diffusion brazing.

3 Claims, 10 Drawing Figures

NOVEL POROUS BODY AND PROCESS FOR ITS PREPARATION

BACKGROUND OF THE INVENTION

The present invention concerns novel porous bodies and a process for their preparation.

It is known to prepare metallic pieces which may be porous, by a diffusion process. The process, effected in the solid state, consists of contacting metallic particles with each other, pressing them and heating them so as to make diffusion of metals from one particle to the other possible.

A process has also been described, in particular in the French patent applications No. 77.06149, filed on Feb. 24, 1977 and No. 78.01318, filed on Jan. 18, 1978, wherein stainless steel pieces are bonded together by interposing between between the faces of the pieces to be joined, a layer of a fusible and diffusible material, then heating the assembly so as to effect the fusion and diffusion of the two pieces of said fusible and diffusible material and finally cooling the assembly. The process may be described as a diffusion brazing process.

SUMMARY OF THE INVENTION

The present invention concerns a diffusion brazing process, which is applied to a base material in bulk—thus having a certain porosity prior to being joined together—and produces final materials of an essentially identical porosity.

The diffusion brazing process according to the invention is applicable to base materials which may consist of nickel, iron, cobalt and various known alloys of these materials. The base materials, which constitute approximately 85 to 99.5% by weight of the final product, must be present in the form of elementary particles such as powders, fibers or chips.

When the base materials are in the form of powders, they have an average grain size in keeping with the intended application of the material; when the base materials are in the form of fibers or chips, the bulk products used may have very low apparent densities; it is, however, preferable to initially compact the accumulations of fibers or chips so that these accumulations will have apparent densities of the same order as those obtained from the same material when present in the form of a powder.

According to the invention, the particles of the base materials are bonded together by means of a low melting point auxiliary material selected from the group comprising tin, indium, antimony, gallium, germanium, or formed of a combination of these elements, by exposing the assembly to a heat treatment in a controlled atmosphere, at a temperature higher than the melting temperature of the auxiliary material, but lower than the solidus temperature of the base material in all cases. In the case wherein particles of base materials of a different nature are present, the temperature of the heat treatment will be controlled by the lowest solidus. The treatment is applied for a period of time sufficient to allow the migration of the auxiliary material and the formation of compounds or of solutions, which insure the diffusion brazing of the particles to be bonded. The amount of the auxiliary material to be used is between 0.5 and 15% by weight with respect to the weight of the final product.

The invention is in part the result of observations of the equilibrium diagrams of pairs of materials, one of which is the base materials of the particles and the other auxiliary material used in the process according to the invention.

It is noted that for certain material pairs and at a certain heat treatment temperature compatible with the base material, on the one hand a solid solution and on the other, a liquid rich in the base material, will be present.

As a function of the rise in temperature to the heat treating temperature, the successive formation of a phase rich in the auxiliary material, then less rich while the liquid becomes enriched in the base material. The liquid then disappears progressively under the effect of diffusion and the concentration in the auxiliary material of the solid solution of the base material declines at the rate at which the material is dispersed.

The auxiliary material used in the process according to the invention is selected from the group of materials generally considered poisons because they degrade the ductility at elevated temperature. This degradation may either be avoided by the accurate dosage of the amount of the interfacial material, or it may be desirable to render the material fragile, for example in the manufacture of certain abradable and friable materials. The requirements relating to the choice of the material used in the process are governed by the fact that this material forms liquid alloys with the base material insuring brazing during the first stage of the process; the diffusion in the second stage involves the flow of the liquid alloys formed, together with an intermetallic diffusion leading to a solid state weld.

Several criteria have been established for the choice of the auxiliary material and for the conduct of the heat treatment.

Primarily, the auxiliary material must be such that: prior to the bonding temperature, there, there is at least one liquid phase, preferably with the principal element of the base material; vapor pressures are sufficiently low so that heating in a furnace under a controlled atmosphere is feasible; dispersion as uniform as possible may be achieved of the auxiliary material within the volume constituted by the particles of the base material. Various known methods may be used for this purpose. For example, physical mixing of the two powders (the auxiliary material on the one hand, and the base material on the other hand) by means of agitation may be sufficient; in the case wherein the base material is in a state of fibers or chips, other modes of dispersion are preferably considered, for example electrolytic deposition, cathodic atomization . . . on said fibers or said chips of the fusible metal. Materials such as tin, indium, antimony, gallium, germanium, satisfy these three conditions and may thus be used in the process of the invention. Calculations performed by applying the laws of diffusion and with consideration of thermodynamic equilibrium diagrams, showed that isothermal solidification times in a Ni or Co base material are shorter when elements such as tin, indium, antimony, gallium, germanium are used, when compared with those required for more conventional elements, such as boron.

The temperature of the heat treatment depends on the nature of the auxiliary material selected, but in any case, it must be sufficient to permit the formation of intermetallic compounds or of sufficiently stable and strong solid solutions. Under these conditions, the heat treating temperature will always be higher than 1050° C. if tin is used as the interface material, higher than 900° C. for elements such as indium or gallium and higher than 1000° C. for antimony and germanium. The limitation of the temperature to the solidus of the particles to be assembled is imposed by the need of not affecting the texture of the assembly in the zone of contact, which would affect detrimentally the characteristics of the bond. In certain cases, the upper range of the temperature must be further reduced to avoid irreversible transformations detrimental to the quality of the base metal, or to be compatible with heat treatments of said material.

The duration of the heating will be comsidered sufficient when, for a given temperature, all of the auxiliary, low melting point material has been diffused inside the base material. It has been noted that, depending on the average diameters of the particles of the base material, the low melting point auxiliary material will diffuse most often into the total volume of said particles.

The final novel porous material according to the invention is characterized by the fact that it comprises approximately 85 to 99.5% by weight of a base material chosen from the group comprising nickel, chromium, tungsten, molybdenum, iron, cobalt and various alloys of these metals, and approximately 15 to 0.5% by weight of a fusible metal selected from the group comprising tin, indium, gallium, germanium, antimony, together with the mixtures and alloys of said metals, by the fact that said base material is present in the form of elementary particles, such as powders, fibers or chips and by the fact that said particles are bonded to each other by diffusion brazing by means of said fusible metal. Resistance to oxidation of the final porous material is obtained by the addition of up to 2% of rare earths or of alkaline metals, or aluminum or magnesium. The porosity of the final product is essentially equal to the porosity of the physical mixture of the particles of the base metal and of the fusible metal prior to heating to effect the operation of diffusion brazing. Thus, the porosity will be substantially that of the untamped material when the base material is in the form of powder. It is possible to modify the porosity, either by tamping the particles of the base material or by adding particles of a material that volatilizes during heating, such as zinc.

BRIEF DESCRIPTION OF THE DRAWINGS

The non-limiting examples to follow hereinbelow, will serve to illustrate the invention, with reference to the drawings, wherein.

DESCRIPTION OF THE PREFERRED EMBODIMENTS

EXAMPLE 1

Figure 1:
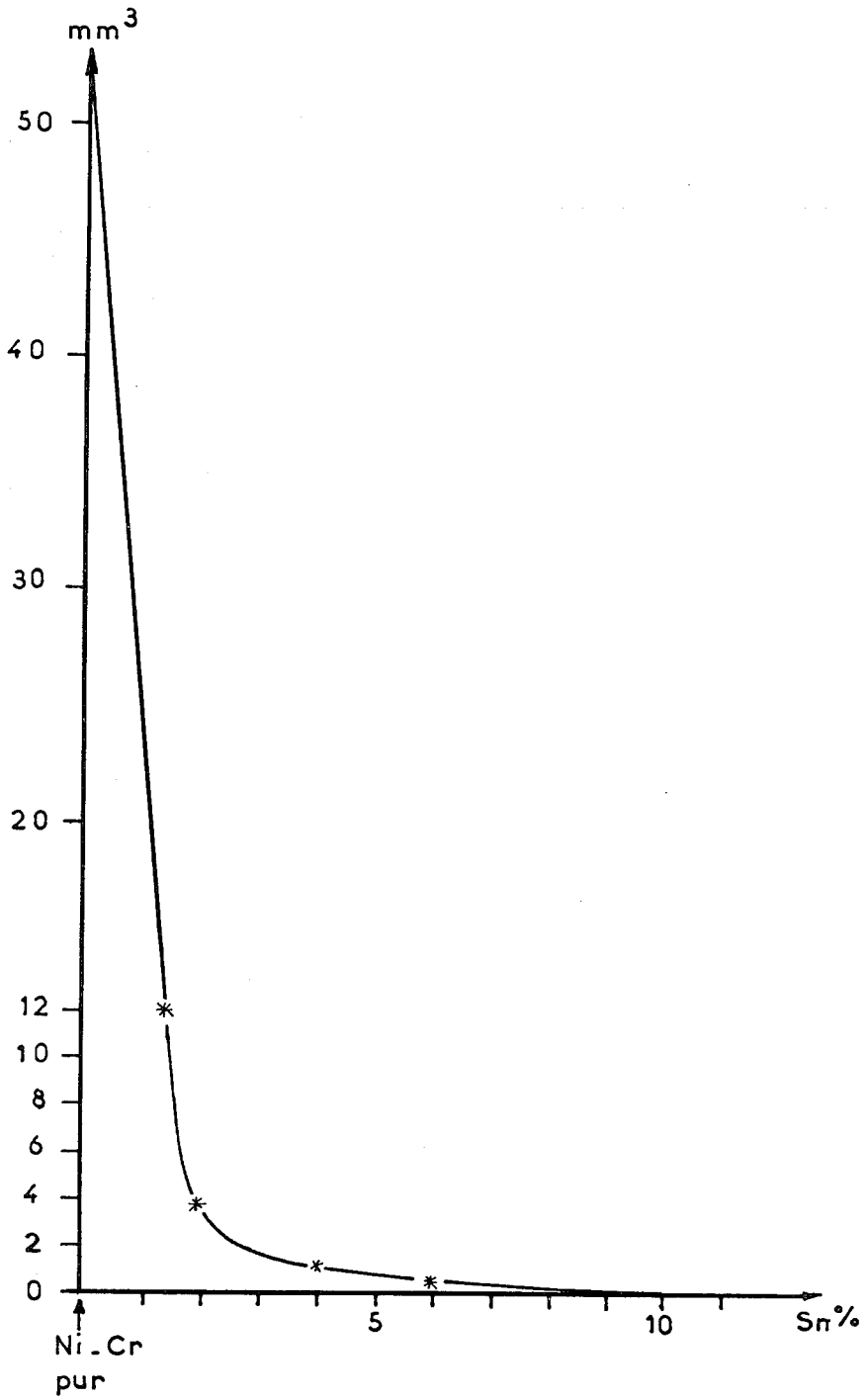
FIG. 1 is a graph plotting loss of volume against the weight of tin present.

An intimate mixture of 93 g chromium powder having an average grain size of between 400 and 800 microns and 7 g of an additive material with an average grain size between 100 and 200 microns, is prepared. Said additive material in the instant case consists of 70% nickel and 30% tin in the powder form. The mixture is poured into an $Al_2O_3$ crucible, which is heated to 1125° C., while a vacuum of $10^{-3}$ Pa is maintained over the mixture. The temperature of 1125° C. is maintained for 15 minutes and the product obtained is removed from the mold. The product is in the form of a porous element wherein the tin has disappeared and the chromiums grains are bonded to each other.

EXAMPLE 2

Example 1 is reproduced by using 90 g of a NK 15 CAT alloy, 3 g tin and 7 g nickel; heating is for 15 minutes at 1100° C. The example is equally valid with 97 g of the alloy NK 15 CAT and 3 g tin.

EXAMPLE 3

An abradable porous body may be prepared by operating as follows:

(100-Y) of an 80/20 nickel-chromium alloy in the form of a powder with a grain size of 160 to 210 microns is mixed with Y g of a tin powder with a grain size of 125 to 200 microns; the mixture is introduced in an $Al_2O_3$ crucible and heated in a vacuum to 1125° C. for 1 hour; cooling is under argon. A porous body is obtained; the erosion resistance of this body has been determined by the standard BS 1615; results are shown by the curve of FIG. 1 representing on the ordinate the loss of volume in $mm^3$ for a testing period of 5 minutes, as a function of the weight of tin in % plotted on the abcissa. The results are also summarized in the following table:

| Y | 0 | 1.5 | 2 | 4 | 6 | 10 |
|---|---|---|---|---|---|---|
| volume loss (in $mm^3$for a 5 mn test | 52 | 12 | 4 | 1.2 | 0.4 | 0 |

Figure 2:
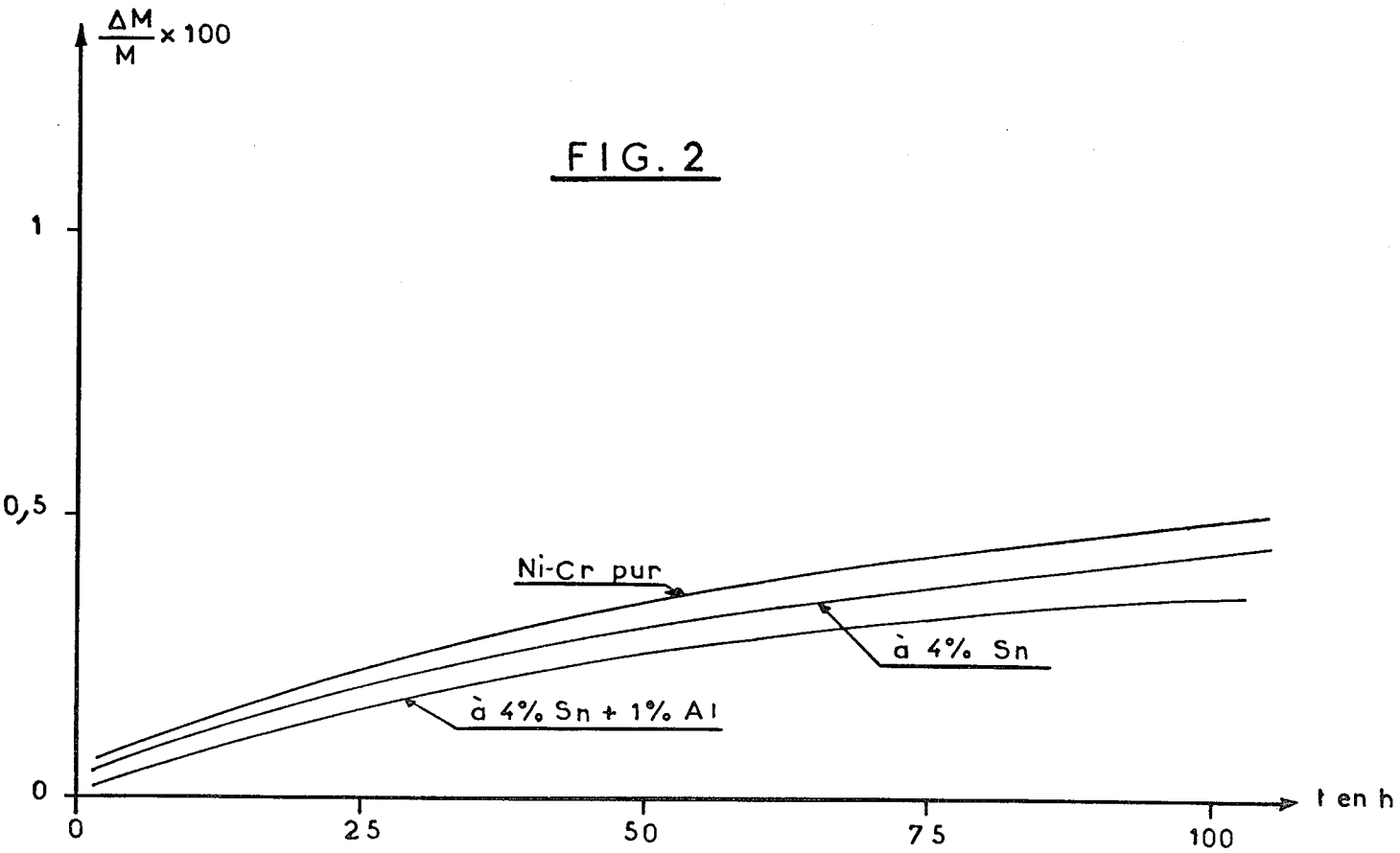
FIG. 2 shows the curve representing the % loss of mass plotted against time.

The porous body prepared with Y=4 g was exposed to a thermal balance, with a thermal shock every 6 hours; this test has shown that the porous body may be used to approximately 900° C.; the oxidation resistance of the porous body may be improved for example by the addition to the mixture of 1% aluminum. These results are illustrated by the curve of FIG. 2, which represents the loss of mass in % plotted on the ordinate as a function of time in hours, plotted on the abcissa. It has been found that the pieces rubbing against such an abradable product, in particular in turbine engines, the "tongues" of the sealing labyrinth or the tips of the blade paddles made of superalloys, do not suffer any wear when operating at elevated temperatures, in relation to the products according to the invention, containing 0.5 to 6% tin. FIGS. 3 to 10 concern examinations performed on a product with 4% tin. The figures are at a scale of magnification of 400.

Figure 3:
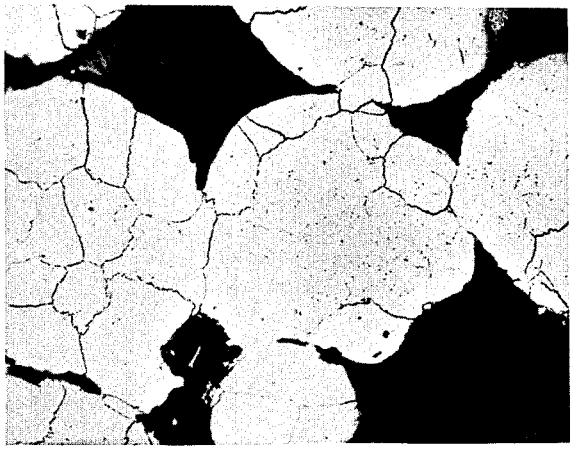
FIGS. 3 to 10 are photographs, magnified 400 times, of a product with 4% tin.
Figure 4:
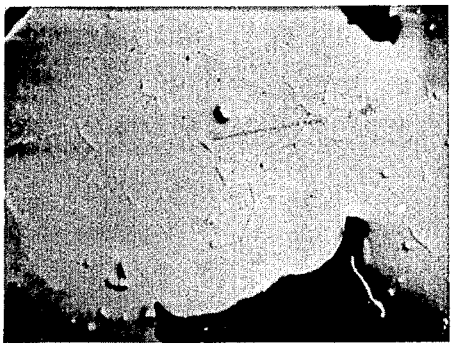
Figure 5:
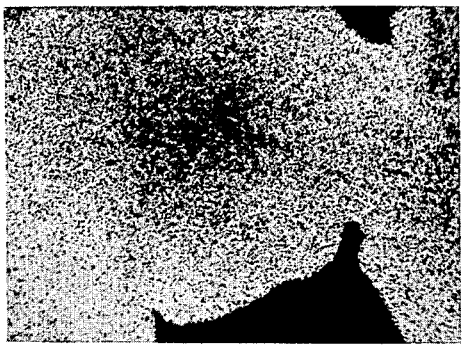
Figure 6:
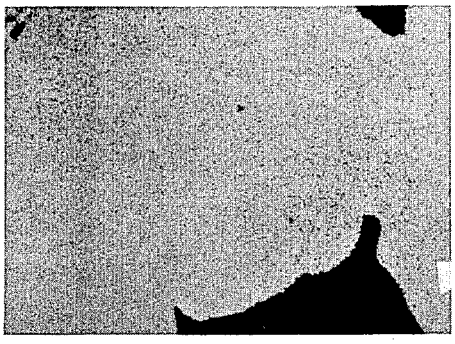
Figure 7:
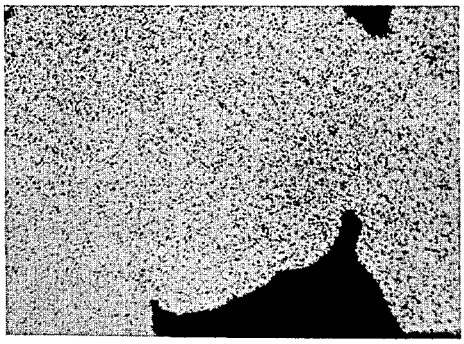
Figure 8:
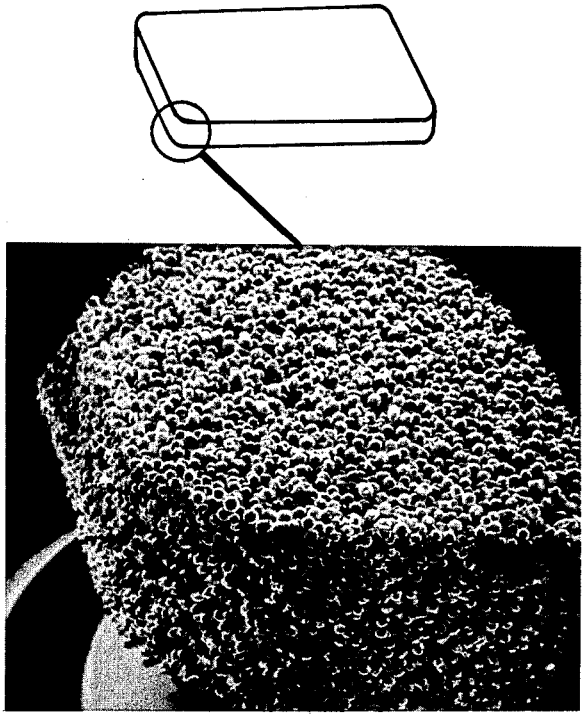
Figure 9:
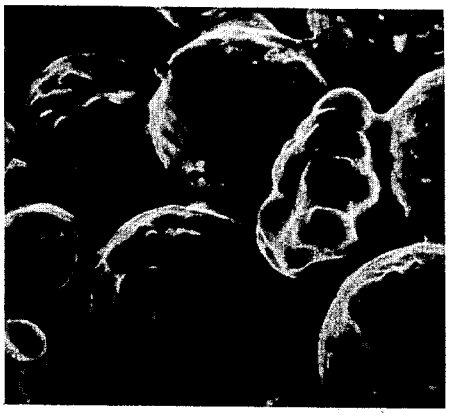
Figure 10:
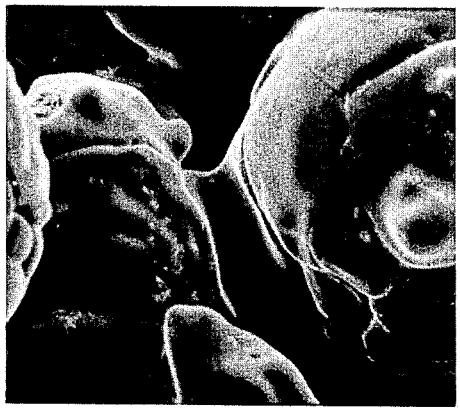

In FIGS. 3 and 4, micrographic examination shows the homogeneous structure of the product and the microanalyses of FIGS. 5, 6 and 7, which concern respectively tin, nickel and chromium, show that tin diffuses practically into the core of the grains of the base material and further that no intermetallic compound which would degrade the quality of the bonds, appears;

In FIGS. 8, 9 and 10, which are enlarged by 12, 175 and 400, respectively, scanning electron microscope examination shows the form of the bonds between the grains of the base material; these bonds, having the shape of "bridges", insure the cohesion of the final product. Finally, it was found that:

the porous product obtained with Y=5 g has a remelting temperature (measured by direct thermal analysis) of 1260° to 1360° C., the porous product obtained with Y=7 g has a remelting temperature of 1253° to 1353° C.

The elementary particles used are a function of the expected wear of the porous body. Powders are especially suitable for porous bodies to be exposed to abrasion, such as those employed as sealing gaskets in turbine engines. In this particular case, the shape and dimensions of the powders may be varied to adjust the properties of the porous bodies. Fibers are used for example to prepare porous bodies used in filters. Chips, on the other hand, are particularly suitable for use as panels in heat exchangers.

I claim:

1. A porous material comprising 85% to 99.5% by weight of a base materials, in the form of elementary particles such as powders, fibers or chips, selected from the group consisting of nickel, cobalt, iron and various alloys of said metals, and approximately 15 to 0.5% by weight of a fusible auxiliary metal chosen from the group consisting of tin, indium, gallium, germanium, antimony, together with the mixtures and alloys of said metals, said elementary particles being joined to each other by diffusion brazing obtained by means of a dispersion of the fusible material within the particles and by heating the assembly, under a controlled atmosphere, at a temperature higher than 900° C., but in all cases lower than the solidus temperature of the base metal, for a period of time sufficient to cause the melting and diffusion of said fusible metal in the base material.

2. A porous material according to claim 1, comprising additionally up to 1% of a material chosen from the group consisting of rare earths, alkali metals, aluminum and magnesium.

3. A porous material according to one of claims 1 or 2 wherein the auxiliary fusible material is initially deposited on the particles of the base material, thus forming a coating on said particles.

* * * * *